US012397965B1

(12) United States Patent
Mir et al.

(10) Patent No.: US 12,397,965 B1
(45) Date of Patent: Aug. 26, 2025

(54) MODULAR CRATE COMPONENTS AND SYSTEMS

(71) Applicant: Crative, LLC, Berkeley, CA (US)

(72) Inventors: Aria Mir, Beverly Hills, CA (US); Wei Chengyuan, Berkeley, CA (US)

(73) Assignee: Crative, LLC, Berkeley, CA (US)

( * ) Notice: Subject to any disclaimer, the term of this patent is extended or adjusted under 35 U.S.C. 154(b) by 0 days.

(21) Appl. No.: 18/785,459

(22) Filed: Jul. 26, 2024

Related U.S. Application Data

(60) Provisional application No. 63/655,489, filed on Jun. 3, 2024.

(51) Int. Cl.
*B65D 6/34* (2006.01)
*B65D 21/08* (2006.01)

(52) U.S. Cl.
CPC ..... *B65D 21/083* (2013.01); *B65D 11/28* (2013.01)

(58) Field of Classification Search
CPC .. B65D 21/083; B65D 11/28; B65D 11/1873; B65D 21/0202; B65D 11/18; B65D 7/24
USPC ..... 220/4.01
See application file for complete search history.

(56) References Cited

FOREIGN PATENT DOCUMENTS

GB 2205085 A * 11/1988 ..... A63H 33/10

* cited by examiner

*Primary Examiner* — Anthony D Stashick
*Assistant Examiner* — L Kmet
(74) *Attorney, Agent, or Firm* — Knobbe Martens Olson & Bear LLP

(57) ABSTRACT

Modular crate components and systems can include panels, connectors, and fasteners useable to create crates of different sizes. The panels can include a plurality of teeth along each of the edges of the panel that can interlock or intermesh with a plurality of teeth of an adjacent panel. At least some of the teeth can include posts that are configured to engage with the connectors to facilitate coupling the panels together. The connectors can include an arrangement of slots that are positioned and configured to engage with the posts included on at least some of the teeth. Each connector can also be configured with an opening configured to receive a fastener therethrough.

19 Claims, 18 Drawing Sheets

MODULAR CRATE COMPONENTS AND SYSTEMS

PRIORITY APPLICATION

This application claims priority to U.S. Provisional Application No. 63/655,489, filed Jun. 3, 2024. Any and all applications for which a foreign or domestic priority claim is identified in the Application Data Sheet as filed with the present application are hereby incorporated by reference under 37 CFR 1.57.

BACKGROUND

Field

This application relates to modular crate components and systems that can be used to construct crates, for example, for shipping or storage of items, of various sizes.

Description

Crates are often used to protect items, for example, during shipping or storage. Typically, crates are constructed from wood and the size of the crate is custom made to accommodate the item to be placed therein.

SUMMARY

This application describes modular crate components and systems that can be used to quickly and efficiently construct crates of different sizes from a set of modular components. The modular components can include panels, connectors, and fasteners (such as bolts). By using different numbers and arrangements of the panels, connectors, and fasteners, crates of different sizes can be constructed.

The panels can include a plurality of teeth along each of the edges of the panel that can interlock or intermesh with a plurality of teeth of an adjacent panel. At least some of the teeth can include posts that are configured to engage with the connectors to facilitate coupling the panels together. Adjacent panels can be arranged at either a 180-degree configuration (allowing for construction of flat sides of different lengths and widths) or 90-degree configurations (allowing for the coupling of the different sides of the crates and the formation of corners).

The connectors can include an arrangement of slots (e.g., T-slots) that are positioned and configured to engage with the posts included on at least some of the teeth. That is, in some embodiments, the connectors can include slots configured to engage with and retain the posts to connect and orient panels relative to each other. Each connector can also be configured with an opening configured to receive a fastener (such as, for example, an M8 bolt). The connectors can be advantageously configured such that the connector can be engaged with two, three, or four adjacent panels (for example, through engagement of the posts and slots) while only requiring a single fastener to secure the connector in place. For example, the slots of the connector can be engaged with posts of multiple panels, while the connector is secured with the fastener to only a single panel. In this way, construction of crates from these modular components is simplified as the total number of fasteners that need to be used is greatly reduced.

These and other aspects of the disclosure will become apparent from the following detailed description, drawings, and appended claims. This summary is provided for illustrative and introductory purposes and is not intended to be limiting.

BRIEF DESCRIPTION OF THE DRAWINGS

The features and advantages of the modular crate components and systems described herein will become more fully apparent from the following description and appended claims, taken in conjunction with the accompanying drawings. These drawings depict only several embodiments in accordance with the disclosure and are not to be considered limiting of its scope. In the drawings, similar reference numbers or symbols typically identify similar components, unless context dictates otherwise. In some instances, the drawings may not be drawn to scale.

DETAILED DESCRIPTION

Figure 1:
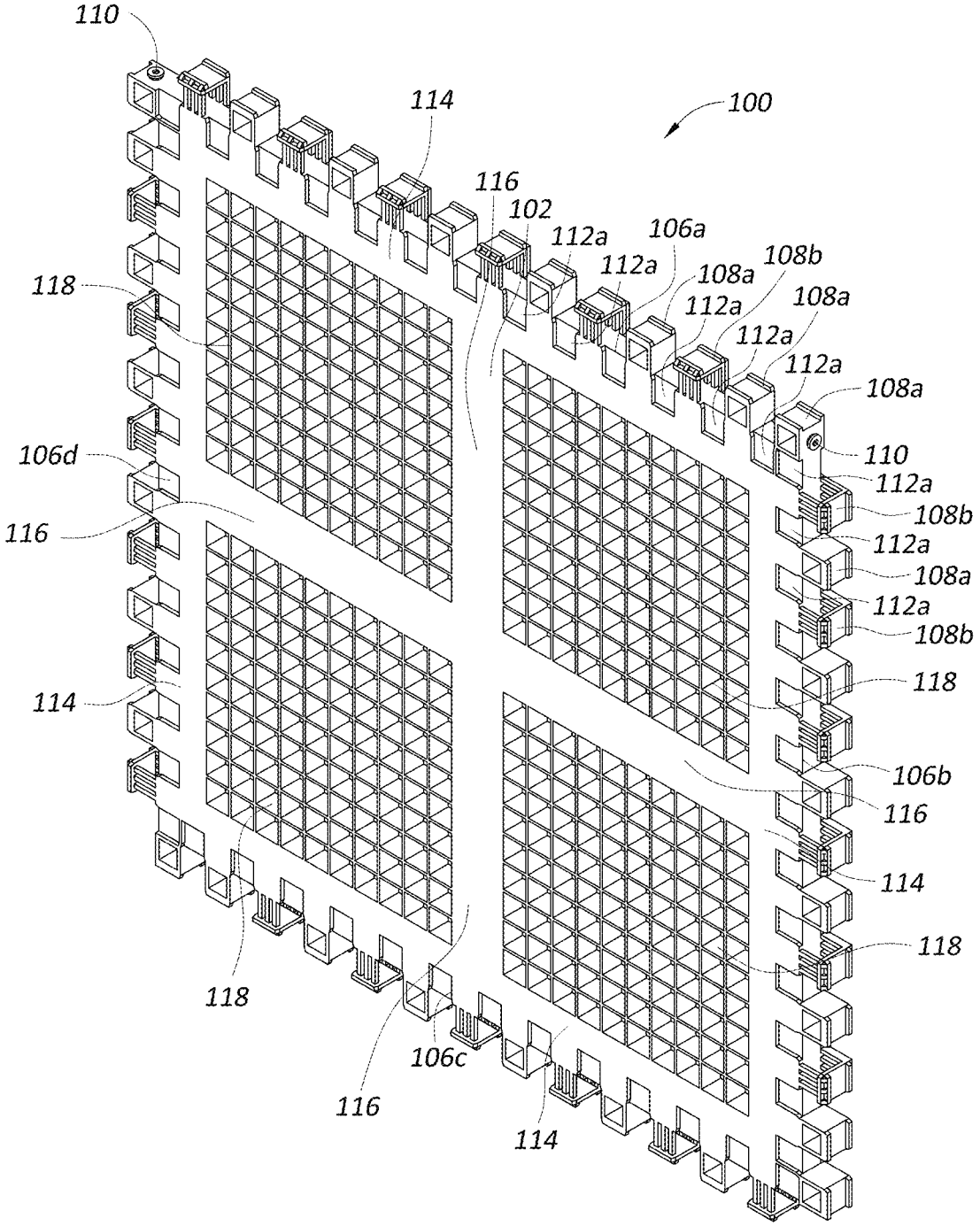
FIG. 1 is a perspective view of an inner surface of an embodiment of a panel for a modular crate system.

This application describes modular crate components and systems that can be used to quickly and efficiently construct crates from a set of modular components. As desired, a user can construct crates with different sizes and configurations by selecting different numbers and arrangements of the modular components.

The modular crate systems described herein provide a number of advantages over the traditional methods for constructing crates. For example, traditional crates are generally made from wood and require specific tooling and woodworking experience to manufacture. Thus, wooden crates are heavy, expensive, and labor intensive to produce. Further, wooden crates are typically either available in standard, non-customizable sizes or custom fabricated in specific sizes on an as-needed basis. This means that wooden crates either are only likely to accommodate standard sized items or must be custom fabricated for uniquely sized items. Additionally, wooden crates are often single use items which may be destroyed as they are opened. The modular crate systems described herein advantageously use a small set of lightweight modular components which can be assembled quickly in a variety of configurations to produce crates of different sizes, without requiring significant tooling, time, or expertise. Further, the modular crate components can be reusable, further reducing waste and cost. In some embodiments, at least some of the modular crate components, such as the modular panels, for example, are made from plastic. Use of plastic can be advantageous because it is more resistant to fire, water, and insects than traditional wooden crates.

The modular components can include panels, connectors, and fasteners (such as bolts).

In some embodiments, a panel for a modular crate system can include a rectangular body. The rectangular body can include an inner surface and an outer surface. The rectangular body can also include a first edge, a second edge, a third edge, and a fourth edge. In some embodiments, the rectangular body can be square. In some embodiments, the square can be 40 inches by 40 inches by 1.5 inches, although other dimensional sizes are possible.

Each edge of the panel can include a plurality of teeth extending outwardly from the edge. The plurality of teeth can be spaced apart such that the plurality of teeth is configured to intermesh with a plurality of teeth of an adjacent panel of the modular crate system to form at least a portion of a modular crate. Adjacent panels can be positioned at either a 180-degree configuration relative to each other in order to form a flat side or a 90-degree configuration relative to each other in order to form a corner. The plurality of teeth along each edge can also include a tooth positioned at one end of the edge that comprises a post configured to engage with a slot of a connector to the couple the panel to the adjacent panel.

In some embodiments, the plurality of teeth positioned along each edge of the panel include at least two different types of teeth. For example, the plurality of teeth can include one or more teeth of a first tooth type and one or more teeth of a second tooth type. In some instances, at least some of the plurality of teeth alternate between the first tooth type and the second tooth type along the edge of the panel. In some embodiments, teeth of the first tooth type include flanges that extend distally from a distal face of the tooth along edges aligned with the inner and outer surfaces of the panel. In some embodiments, teeth of the second tooth type also include flanges that extend distally from a distal face of the tooth along edges aligned with the inner and outer surfaces of the panel, but also include flanges that extend orthogonally from inner and outer faces of the teeth at the distal end of the tooth.

In some embodiments, when two panels are arranged adjacently in a 180-degree (flat) configuration, the distally extending flanges of the first and second teeth types overlap a portion or are received within corresponding recesses on the inner and outer surfaces of the adjacent panel. This overlap facilitates and strengthens a flat connection between the adjacent panels. In some embodiments, when two panels are arranged adjacently in a 90-degree (corner) configuration, the orthogonally extending flanges of the second teeth type overlap a portion or are received within corresponding recesses on the inner and outer surfaces of the adjacent panel. This overlap facilitates and strengthens a corner connection between the adjacent panels.

The plurality of teeth can also include one or more teeth that are configured for further engagement with a connector of the modular crate system. For example, a tooth on one end of each edge of the panel can include a post that extends from a side surface of the tooth. The post can be configured to engage with a slot of the connector. The post can take many forms. In some embodiments, the post comprises a cylindrical projection terminating in a circular flange. In some embodiments, the post further comprises an opening extending along a longitudinal axis of the post. The opening is threaded and configured to receive a fastener (e.g., a bolt). In some embodiments, the bolt comprises an M8 bolt, although other bolts or fasteners can be sued. The fastener can thus be used to secure the connector to the post of a panel.

In some embodiments, a connector for a modular crate system can include a cubic body comprising an upper surface and an opposed lower surface, and four side surfaces extending between the upper surface and the lower surface.

The connector can further include an opening extending through the cubic body from the upper surface to the lower surface. The opening can be configured to receive a shaft of a bolt therethrough. In some embodiments, the opening is not threaded, although in other embodiments, the opening can be threaded. In some embodiments, the bolt comprises an M8 bolt, although other bolts or fasteners can be used. In some embodiments the upper surface comprises a recess configured to receive a head of a bolt inserted through the opening. As mentioned above, an advantage of the modular crate system is that only a single fastener is required for each connector. That is, one fastener is used to secure the connector to one panel, but the connector is further engaged with one, two, three, or four other panels through the engagement of its slots with corresponding posts of the other panels.

Accordingly, the connector can further include, for each of the side surfaces, a slot formed into the side surface and extending from the lower surface towards the upper surface. In some embodiments, the slot comprises a T-shaped slot. In some embodiments, The T-shaped slot is configured such that the circular flange at the end of the post can be retained therein.

In some embodiments, the cubic body of the connector is 1.5 inches by 1.5 inches by 1.5 inches. Other dimensions for the connector are possible. In some embodiments, the dimensions of the connector are configured to correspond with the thickness of the panels.

The following discussion presents detailed descriptions of the several embodiments of a modular crate components and systems as shown in the figures. These embodiments are not intended to be limiting, and modifications, variations, combinations, etc., are possible and within the scope of this disclosure.

Figure 2:
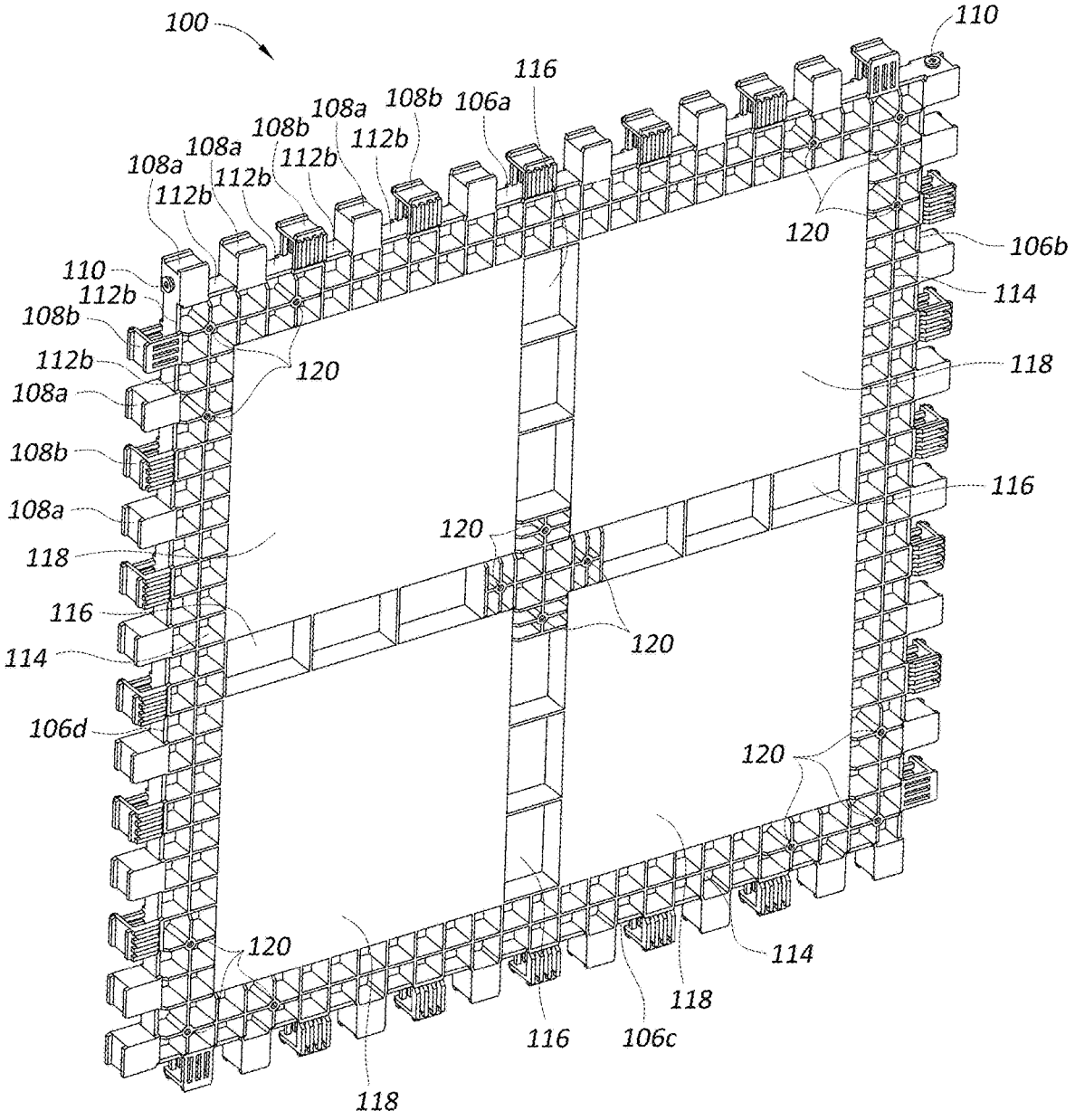
FIG. 2 is a perspective view of an outer surface of an embodiment of the panel for the modular crate system of FIG. 1.
Figure 3:
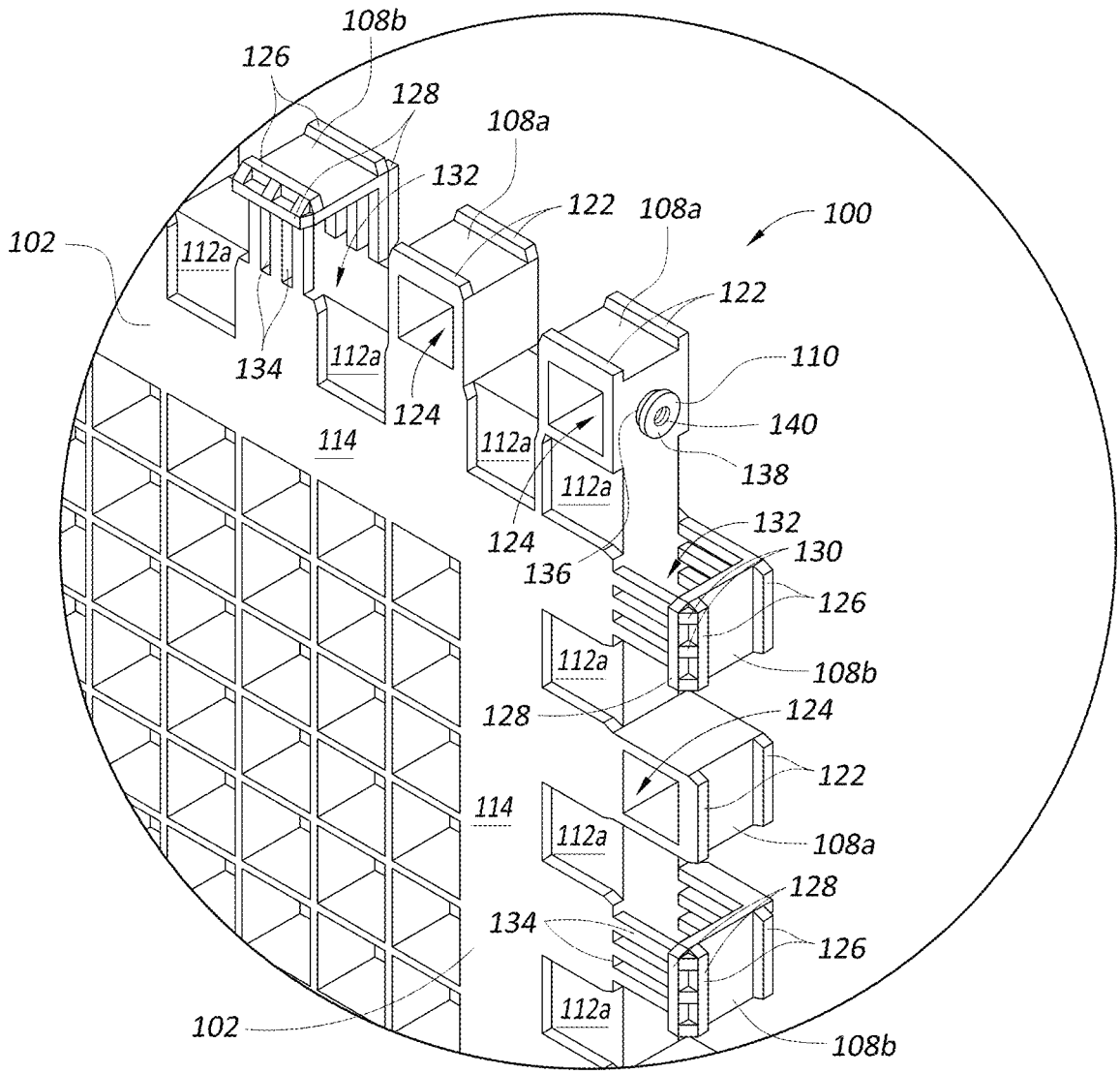
FIG. 3 is a detail perspective view of an inner surface of a corner of the panel of the modular crate system of FIG. 1, illustrating features of a plurality of teeth of the panel in greater detail.

FIGS. 1-3 illustrate various views of an embodiment of a panel 100 of a modular crate system. FIG. 1 is a perspective view of an inner surface 102 of the panel 100, FIG. 2 is a perspective view of an outer surface 104 of the panel 100, and FIG. 3 is a detail view of a corner of the panel 100.

Beginning with FIGS. 1 and 2, showing the inner surface 102 and the outer surface 104 of the panel 100, respectively, in the illustrated embodiment, the panel 100 generally comprises a rectangular body having a thickness measured between the outermost portions of the inner surface 102 and the outermost portions of the outer surface 104 and bounded on its lateral edges by a first edge 106*a*, a second edge 106*b*, a third edge 106*c*, and a fourth edge 106*d*. Because, in some embodiments, each of the first edge 106*a*, the second edge 106*b*, the third edge 106*c*, and the fourth edge 106*d* are substantially similar, reference numeral 106 is used herein to refer to any edge generically. Further, while the inner surface 102 and the outer surface 104 are referred to herein as surfaces, this term is used broadly. For example, as shown, not all features on the inner surface 102 (FIG. 1) and the outer surface 104 (FIG. 2) need lie in a single plane. In the illustrated embodiment, the rectangular body comprises a square shape, although this need not be the case in all embodiments. Further, various dimensions for the panel 100 are possible. For example, in an embodiment, the panel 100 is 40 inches by 40 inches by 1.5 inches, although this is provided only by way of example and other sizes are possible.

Figure 7:
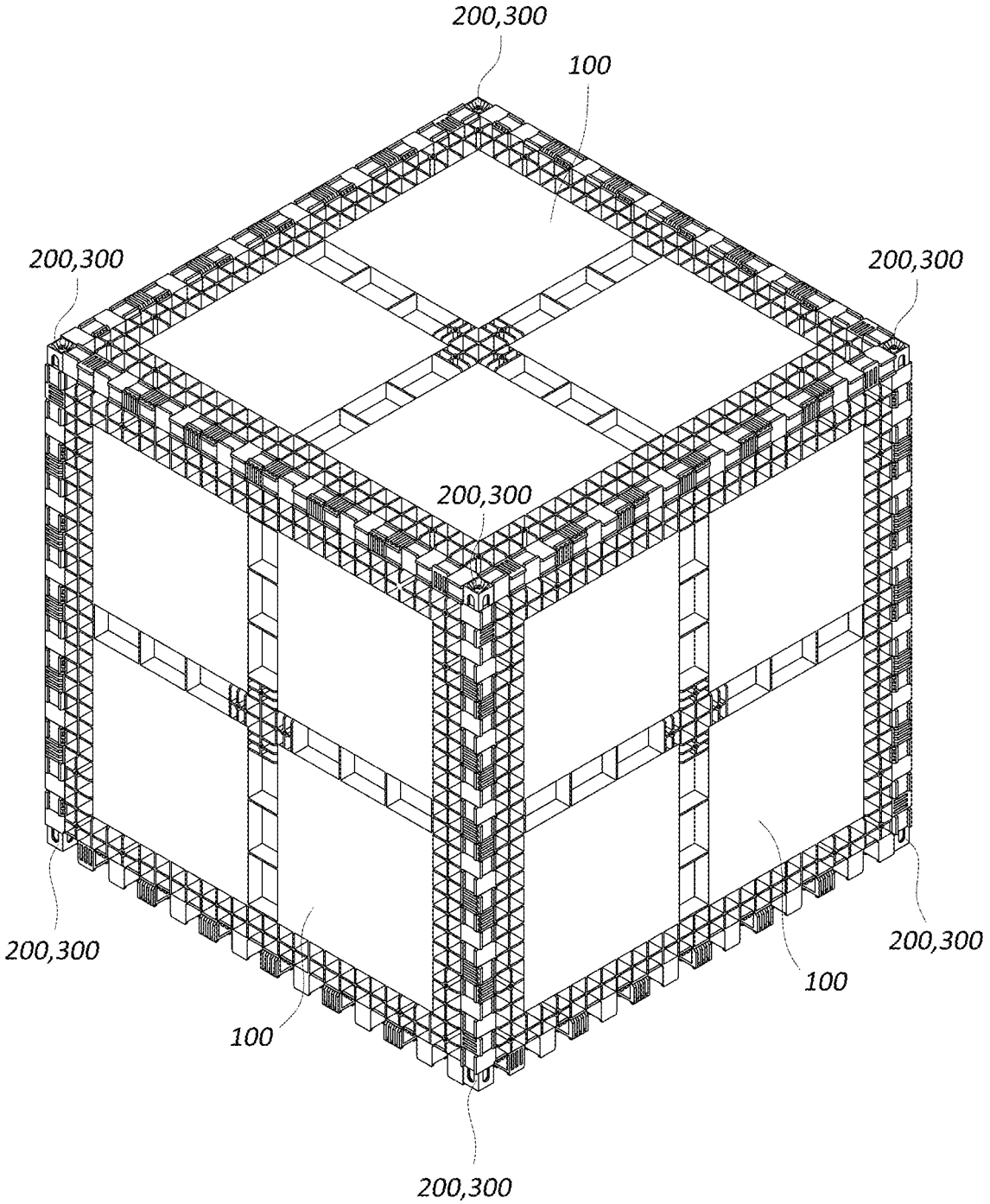
FIG. 7 is a perspective view showing a first example of a modular crate assembled using a plurality of the panels of FIG. 1, a plurality of connectors of FIG. 4, and a plurality of fasteners of FIG. 6.
Figure 8:
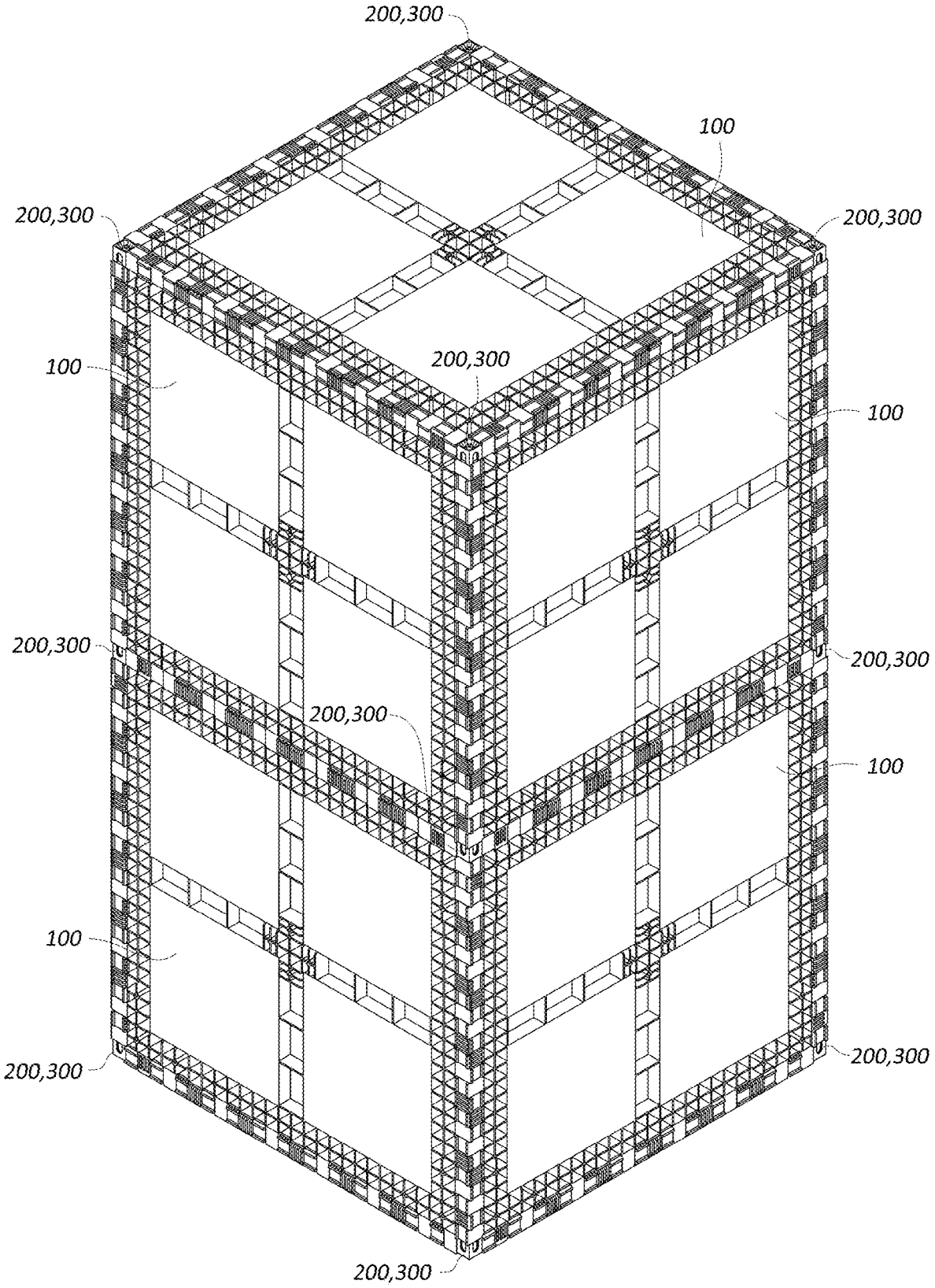
FIG. 8 is a perspective view showing a second example of a modular crate assembled using a plurality of the panels of FIG. 1, a plurality of connectors of FIG. 4, and a plurality of fasteners of FIG. 6.
Figure 9:
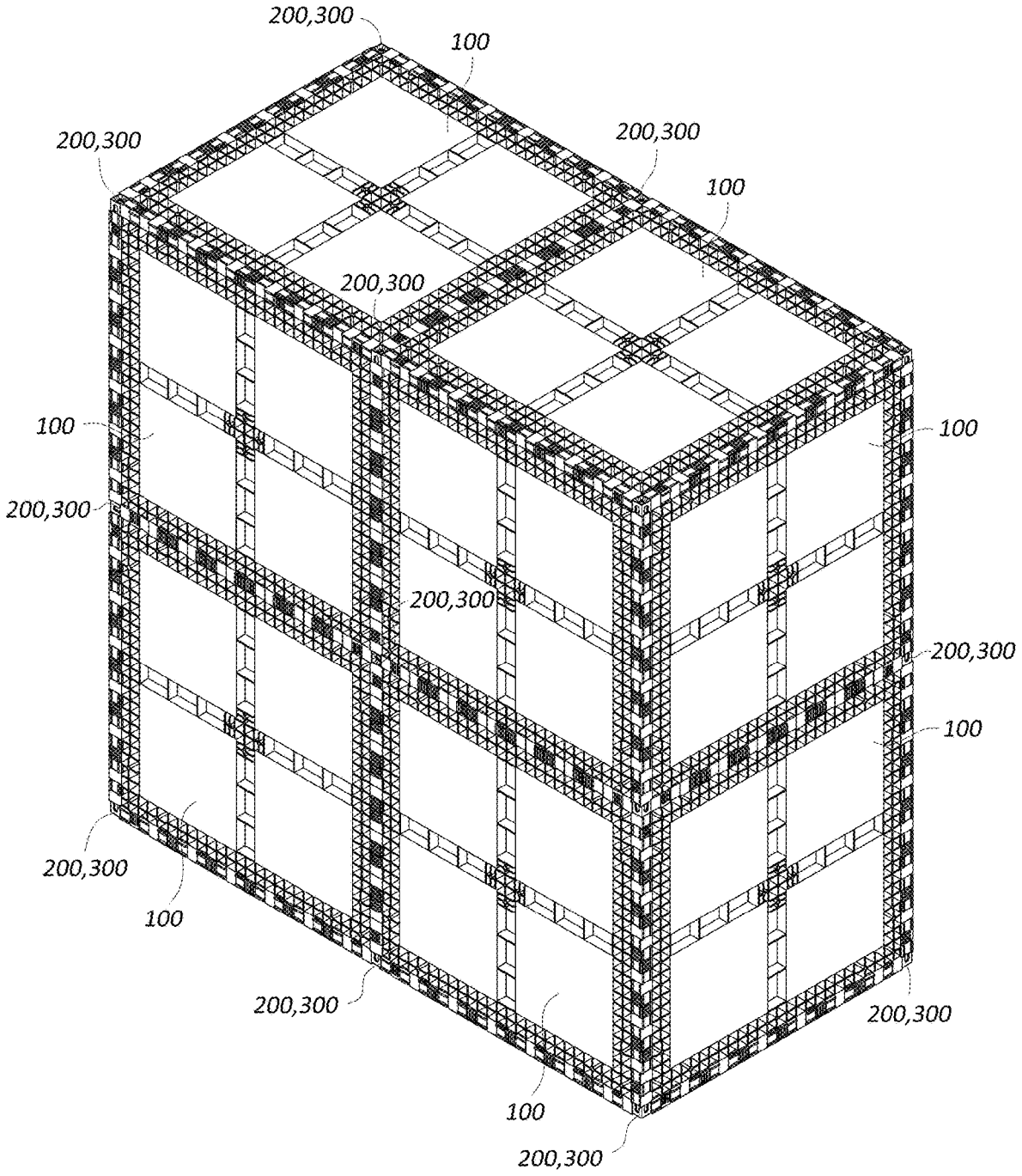
FIG. 9 is a perspective view showing a third example of a modular crate assembled using a plurality of the panels of FIG. 1, a plurality of connectors of FIG. 4, and a plurality of fasteners of FIG. 6.

As shown in FIGS. 1 and 2, each edge 106 of the panel 100 is provided with a plurality of teeth 108. In the illustrated embodiment, the panel 100 includes two types of teeth: a first tooth type 108*a* and a second tooth type 108*b*. Reference numeral 108 is used to refer to any of the teeth generically, while reference numerals 108*a* and 108*b* are used to refer to a tooth of the first or second tooth type, respectively. The teeth 108 will be described in more specific detail below with reference to the detail view of FIG. 3, which shows an enlarged corner of the panel 100. FIGS. 1 and 2, however, show that the teeth 108 can be spaced apart along the edges 106 of the panel 100. In general, the teeth 108 are spaced apart such that they are configured to intermesh with teeth of an adjacent panel 100 of the modular crate system when the panels 100 are assembled. Examples of assembled crates are shown in FIGS. 7-9 and example joints between adjacent panels 100 are shown in more detail in FIGS. 10-15, which are described in more detail below. To accommodate intermeshing of teeth 108 of adjacent panels, the width between teeth 108 on a panel 100 can generally be equal to the width of each tooth 108. In this manner, when intermeshed, teeth 108 generally do not comprise gaps therebetween.

Figure 5:
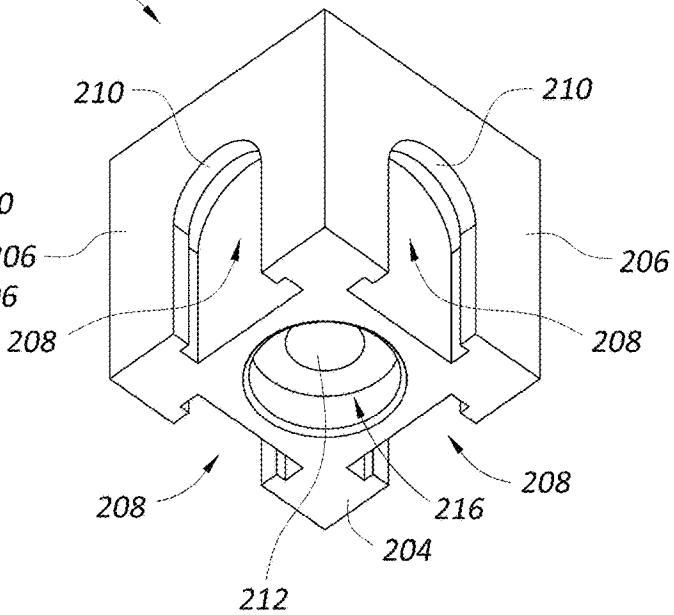
FIG. 5 is a bottom perspective view of the connector of FIG. 4.
Figure 4:
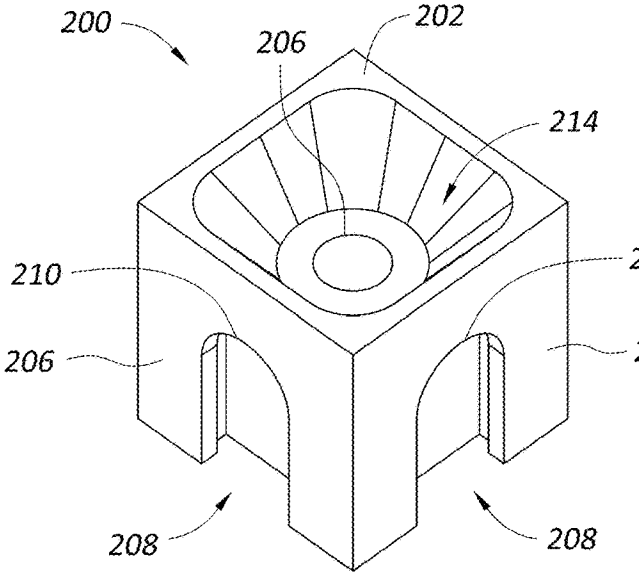
FIG. 4 is a top perspective view of an embodiment of a connector for a modular crate system.

As also shown in FIGS. 1 and 2, the panel 100 can include at least one tooth 108 on each edge 106 that includes a post 110. The post 110 can be configured for engagement with a connector 200 as shown in FIGS. 4 and 5. The post 110 can also be configured to receive a fastener, for example, the bolt 300, shown in FIG. 6. The post 110, connector 200, and fastener 300 will be described in more detail further below. In the illustrated embodiment of the panel 100 of FIGS. 1 and 2, the tooth 108 that includes the post 110 is the tooth positioned at one end of the edge 106. In the illustrated embodiment, the post 110 extends from a side surface of the tooth 108.

The panel 100 can be configured to be lightweight, yet rigid and durable. In the illustrated embodiment, the panel 100 comprises a frame or boarder 114 that extends around the edges 106 of the panel 100. As shown in FIG. 1, the boarder 114 can comprise a smooth surface lying in a plane on the inner surface 102 of the panel 100. As shown in FIG. 2, the boarder 114 can comprise a plurality of recessed squares on the outer surface 104 of the panel 100. This configuration provides a light weight, while maintaining structural rigidity. In the illustrated embodiment, the panel 100 also comprises interior crossbeams 116 that extend across the panel 100 connecting opposite sides of the boarder 114. As shown in FIG. 1, the crossbeams 116 can comprise a smooth surface lying in a plane on the inner surface 102 of the panel 100. As shown in FIG. 2, the crossbeams 116 can comprise a plurality of support baffles on the outer surface 104 of the panel 100. This configuration provides further provides a light weight, while maintaining structural rigidity. In some embodiments, the panels 100 may be made from a plastic material.

As shown in FIGS. 1 and 2, the boarder 114 and crossbeams 116 divide the panel into four interior sections 118. As shown in FIG. 1, the interior sections 118 can comprise a plurality of recessed squares on the inner surface 102 of the panel 100. As shown in FIG. 2, the interior sections 118 can comprise a smooth surface lying in a plane on the outer surface 104 of the panel 100. This configuration again provides a light weight, while maintaining structural rigidity. In some embodiments, the flat surfaces of the crossbeams 116 and/or the boarder 114 on the inner surface 102 can provide surfaces to which adhesives can be adhered, for example, to apply foam blocks or other cushioning or supporting materials. The recessed portions of the crossbeams 116 and/or boarder 114 on the outer surface 104 can be used as grab handles to facilitate handling of a modular crate.

Figure 16:
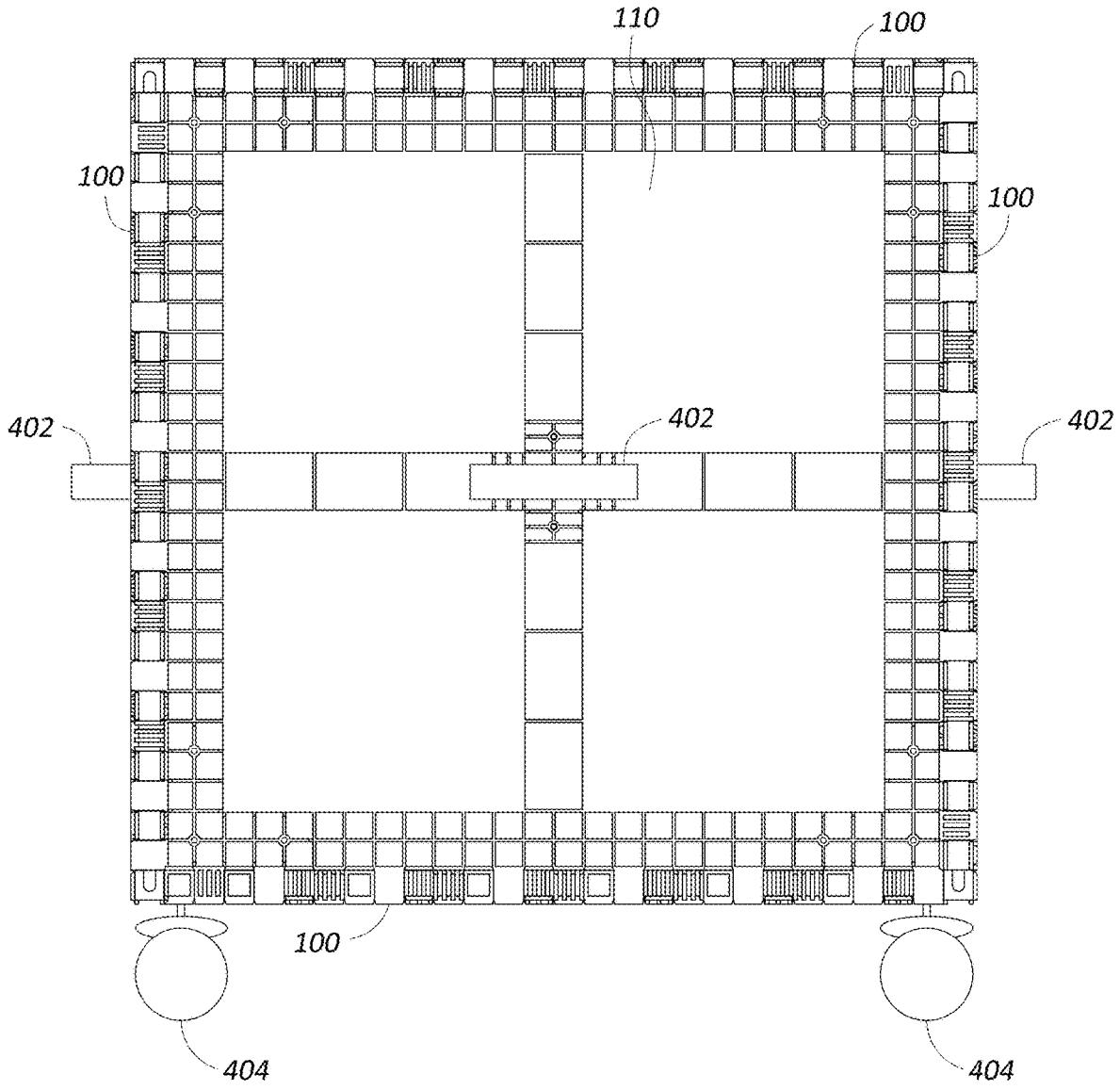
FIG. 16 shows an example modular crate with example handles and wheels attached to outer surfaces thereof.
Figure 17:
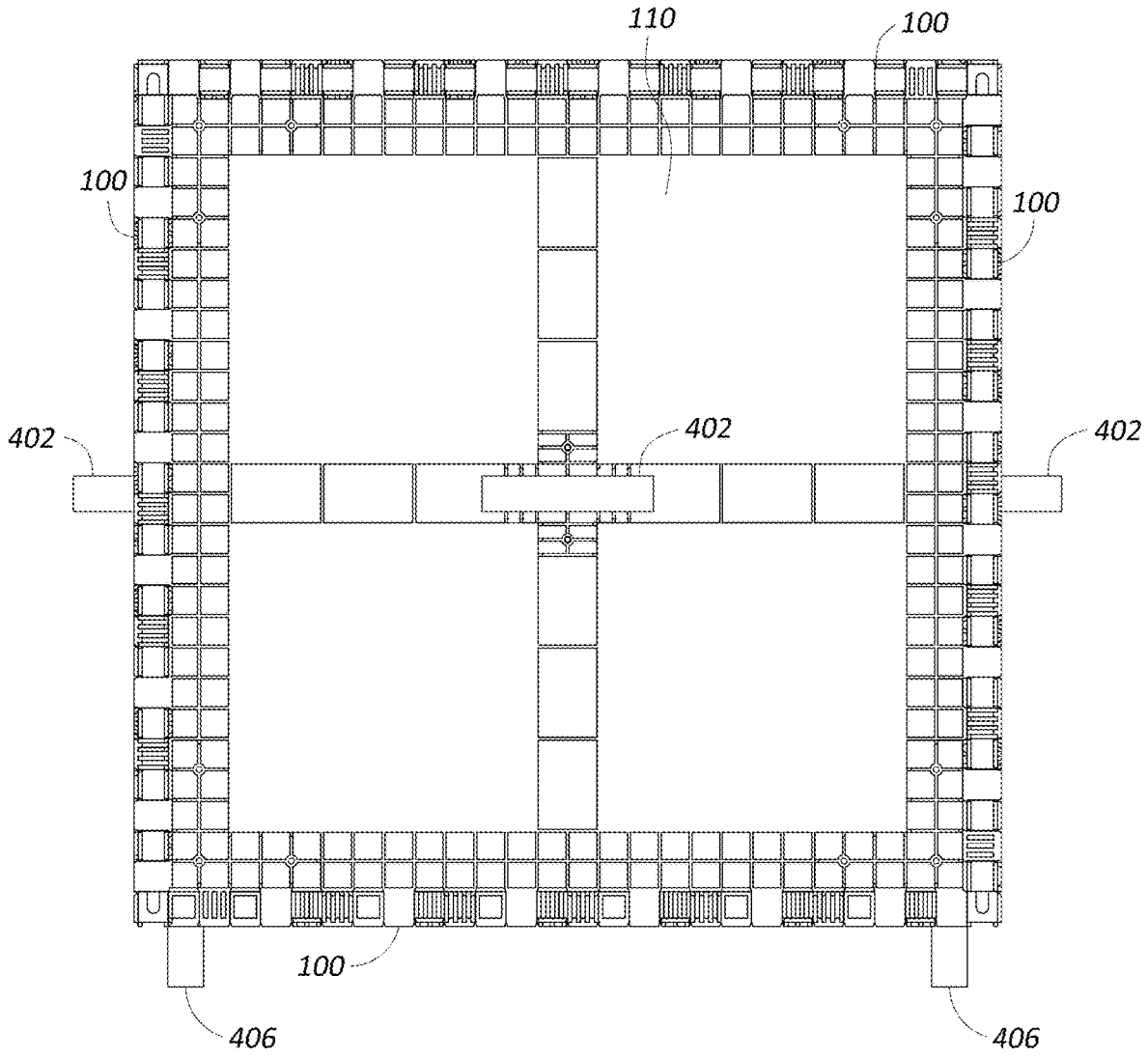
FIG. 17 shows an example modular crate with example handles and legs attached to outer surfaces thereof.
Figure 18:
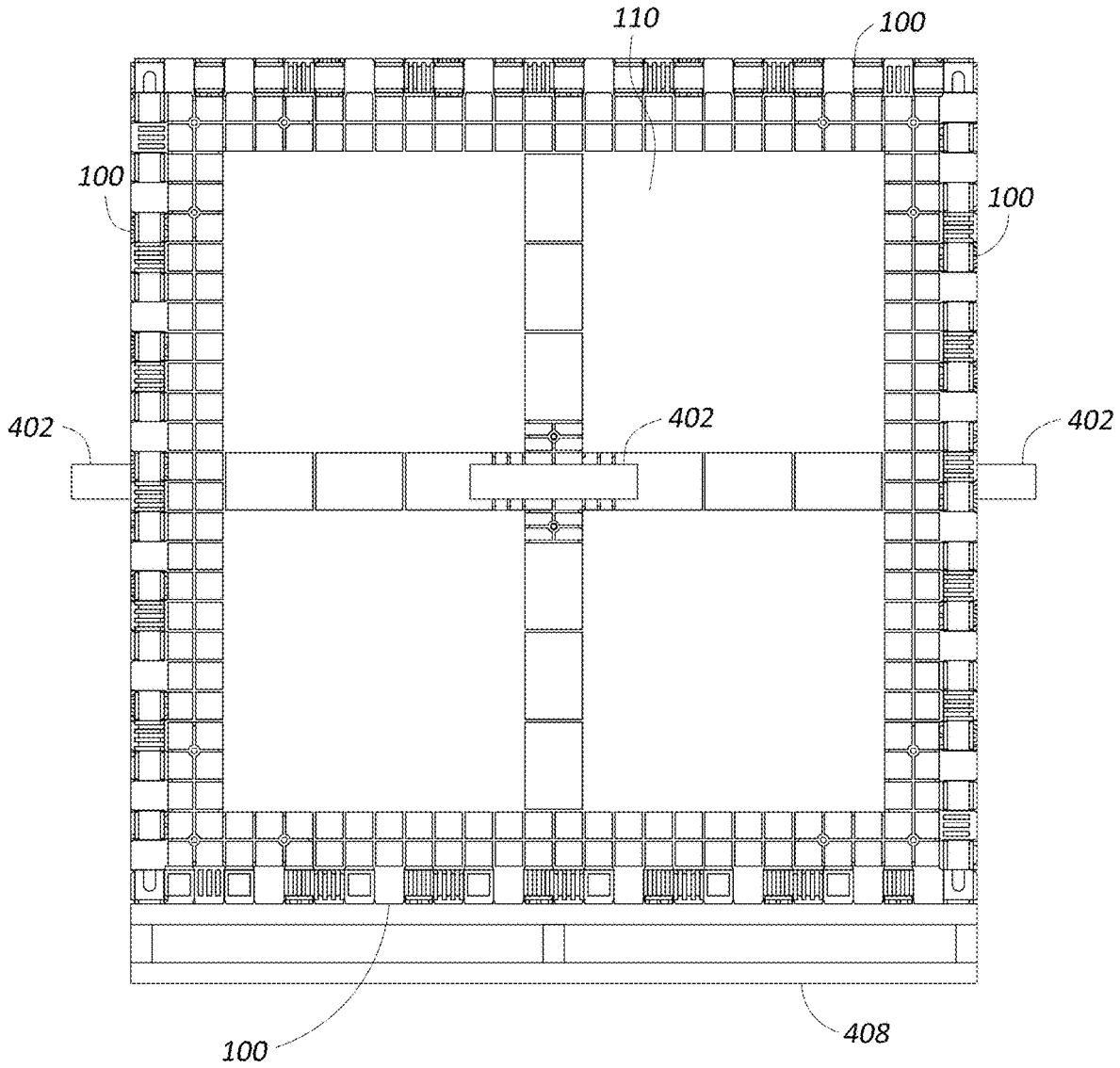
FIG. 18 shows an example modular crate with example handles and a pallet base attached to outer surfaces thereof.

FIG. 2 also illustrates that the outer surface 104 of the panel 100 can include a plurality of attachment locations 120 that can be used to attach components to the exterior of a crate formed by the panel 100. In the illustrated embodiment, the attachment locations 120 comprise threaded holes configured to receive fasteners, such as bolts. The fasteners can be used to secure various items such as wheels, pallet legs, handles, feet, etc., to the outer surface 104 of the panel 100. Examples are shown in FIGS. 16-18 which are described below. In the illustrated embodiment, the attachment locations 120 are provided at the corners of the boarder 114 and at the center of the crossbeams 116, although other numbers and locations for the attachment locations 120 can also be used. In some embodiments, attachment locations 120 can be included on the inner surface 102 of the panel 100. In some embodiments, the inner surface 102 of the panel 100 can be configured for use with internally attaching components. For example, in some embodiments, the internally attaching components can be configured to engage with the square recesses in the interior sections 118. For example, crossbeams or supports that are used to support an item within the crate or divide the interior of the crate into smaller sub compartments can be configured to engage with the square recesses in the interior sections 118.

In some embodiments, for example as illustrated, the panel 100 can include recesses 112, such as the recesses 112*a* of FIG. 1 and recesses 112*b* of FIG. 2 on the boarder 114 at locations positioned between the teeth 108. These recesses 112 can be configured to receive features of the teeth 108 as will be described below with reference to FIGS. 3 and 10-15.

In some embodiments, the panel 100 can be made from a rigid plastic material, although other materials are also possible.

FIG. 3 is a detail perspective view of the inner surface 102 of a corner of the panel 100 of FIG. 100. FIG. 3 will now be described with a particular emphasis on features of the teeth 108 (e.g., of the first tooth type 108*a* and the second tooth type 108*b*) and the post 110.

In the enlarged view of FIG. 3, the features of the first tooth type 108*a* are more visible. As shown, in the illustrated embodiment, teeth of the first tooth type 108*a* can include distally extending flanges 122 that extend from a distal face of the tooth 108*a*. A first of the distally extending flanges 122 can be positioned on an edge of the distal face of the tooth on the inner side of the panel 100, and a second of the distally extending flanges 122 can be positioned on an edge of the distal face of the tooth on the outer side of the panel 100. When two panels 100 are joined in a flat, for example, 180-degree configuration, the distally extending flanges 122 overlap with or are at least partially received in the recesses 112*a*, 112*b* on the inner surface 102 and outer surface 104 of the panel 100, respectively. This overlap or engagement strengthens the joint between adjacent panels 100.

FIG. 3 also illustrates that, in some embodiments, the first tooth type 108*a* can include an opening 124 that extends through the tooth 108*a* from the inner side to the outer side. In the illustrated embodiment, the opening is square, although this need not be the case in all embodiments. In some embodiments, the opening 124 can be omitted or oriented differently. In some embodiments, the teeth 108*a* are configured with the opening 124 such that they are provided with some flexibility. The flexibility can allow the teeth 108 to interlock together and unlock more easily.

Turning now to the features of the second tooth type 108*b*, teeth of the second tooth type 108*b* can include distally extending flanges 126, similar to the distally extending flanges 122 of the first tooth type 108*a* previously described. For example, the second tooth type 108*b* can include distally extending flanges 126 that extend from a distal face of the tooth 108*b*. A first of the distally extending flanges 126 can be positioned on an edge of the distal face of the tooth on the inner side of the panel 100, and a second of the distally extending flanges 126 can be positioned on an edge of the distal face of the tooth on the outer side of the panel 100. When two panels 100 are joined in a flat, for example, a 180-degree configuration, the distally extending flanges 126 overlap with or are at least partially received in the recesses 112*a*, 112*b* on the inner surface 102 and outer surface 104 of the panel 100, respectively. This overlap or engagement strengthens the joint between adjacent panels 100.

As shown in FIG. 3, the second tooth type 108*b* also includes orthogonally extending flanges 128. A first of the orthogonally extending flanges 128 extends orthogonally from a distal end of the inner face of the tooth 108*b*, and a second of the orthogonally extending flanges extends orthogonally from the distal end of an outer face of the tooth 108*b*. When two panels 100 are joined in a corner configuration, for example, a 90-degree configuration, the orthogonally extending flanges 128 overlap with or are at least partially received in the recesses 112*a*, 112*b* on the inner surface 102 and outer surface 104 of the panel 100, respectively. This overlap or engagement strengthens the joint between adjacent panels 100. In some embodiments, for example, as illustrated, the distally extending flanges 126 and the orthogonally extending flanges 128 can be connected and supported with support buttresses 130 as shown.

FIG. 3 also illustrates that, in some embodiments, the second tooth type 108*b* can include a longitudinal opening 132 that extends through the tooth 108*b* from the one side to the other in a longitudinal direction that is parallel with the edge 106 of the panel. In the illustrated embodiment, the longitudinal opening 132 is square, although this need not be the case in all embodiments. In some embodiments, the teeth 108*b* are configured with the longitudinal opening 132 such that they are provided with some flexibility. The flexibility can allow the teeth 108 to interlock together and unlock more easily. In some embodiments, the opening 132 can be omitted or oriented differently. In the illustrated embodiment, the second tooth type 108*b* also includes transverse slits 134 positioned on the inner and outer faces of the tooth 108*b*. Such transverse slits 134 may be included to reduce the cost and complexity of an injection molding process that is used to form the panel 100. These need not be present in all embodiments.

As shown in FIG. 3, in the illustrated embodiment, the post 110 can include a projection 136, which can be cylindrical or other shapes, extending from a side surface of a first tooth 108 on the edge 106 of the panel. The cylindrical projection 136 can terminate at a flange 138, which can be circular or other shapes, having a wider diameter than that of the cylindrical projection 136. The post 110 is configured to be retained within a slot of the connector, such as the connector shown in FIGS. 4 and 5. Although the post 110 is shown as a cylindrical projection and circular flange, other shapes for the post 110 are possible.

Figure 19:
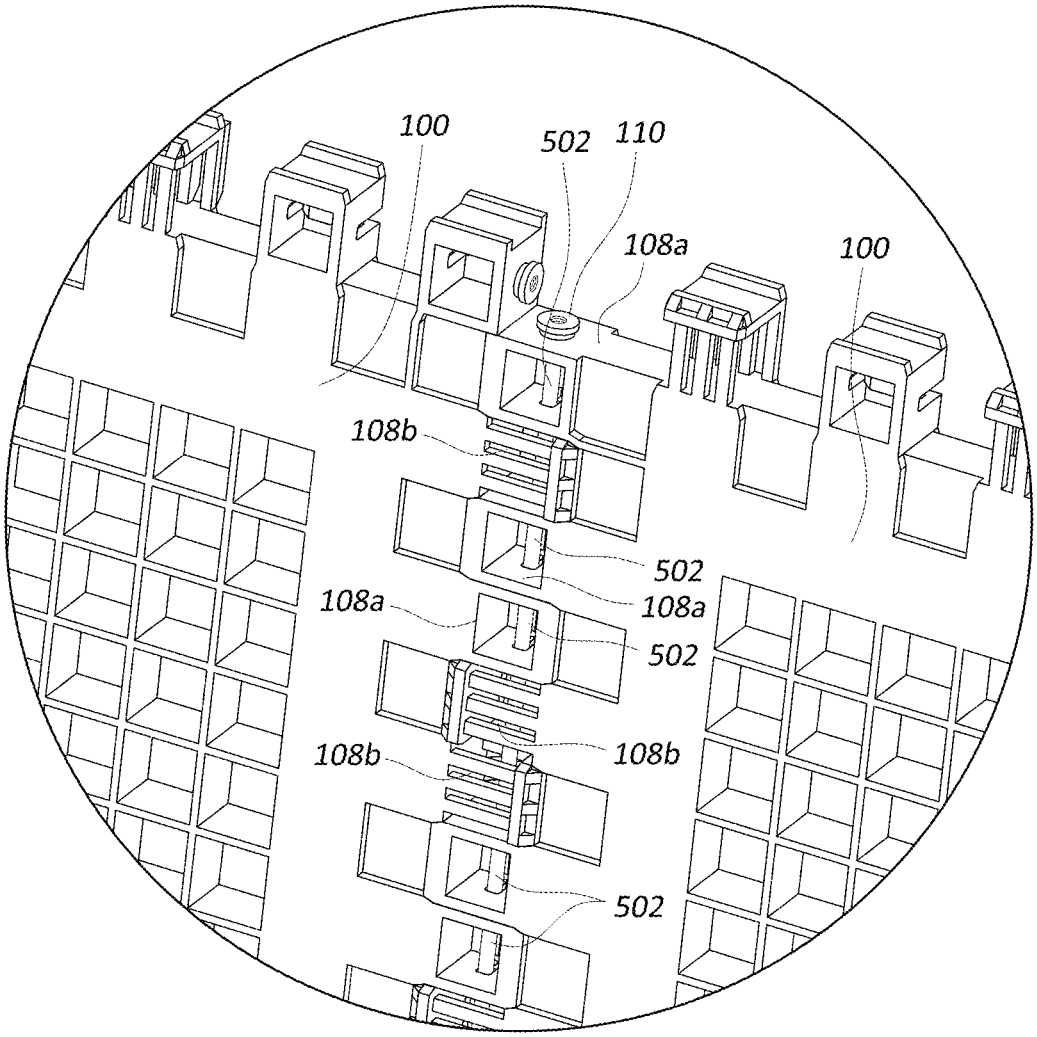
FIG. 19 illustrates an example joint between two modular panels that includes a rod to strengthen the joint.
Figure 20:
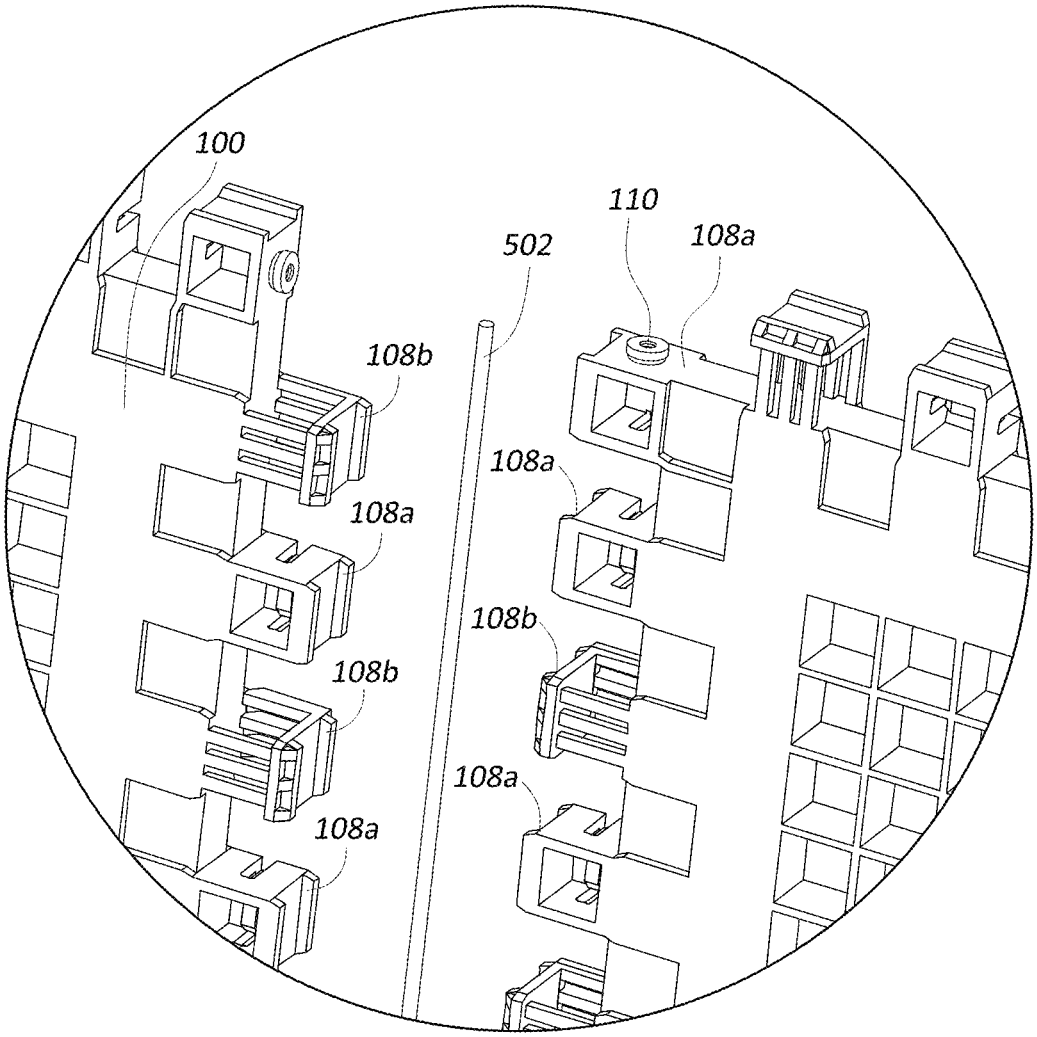
FIG. 20 is an exploded view of the joint of FIG. 19.

In the illustrated embodiment, an opening 140 extends through the post 110 along a longitudinal axis of the post 110. The opening 140 can be configured to receive a fastener, such as the bolt 300 of FIG. 6. For example, in some embodiments, an internal surface of the opening 140 can be threaded for engagement with a threaded shaft of the bolt 300. In some embodiments, the opening 140 can extend entirely through the tooth 108 and all of the teeth along the edge. In such embodiments, a rod can be inserted through the opening and through the intermeshed teeth 108 of two adjacent panels 100 to further strengthen a connection between the panels 100, for example, as shown in FIGS. 19 and 20 described below.

FIGS. 4 and 5 show top perspective and bottom perspective views, respectively, of an embodiment of a connector 200 for a modular crate system. The connector 200 can be used to facilitate securement and connection between two or more of the panels 100. Advantageously, in some embodiments, only a single fastener or bolt is needed to secure the panels 100 and the connector 200.

As shown in FIGS. 4 and 5, the connector 200 can comprise a cubic body having an upper surface 202, a lower surface 204, and four side surfaces 206 extending between the upper and lower surfaces 202, 204. As shown, each of the side surfaces 206 can include a slot 208 formed therein. Further, an opening 212 extends through the connector 200 from the upper surface 202 to the lower surface 204.

The cubic body of the connector 200 can be any size that corresponds with the size of the panels 100. For example, typically, the length, width, and height dimensions of the connector 200 would correspond with the thickness of the panel 100. For example, where the panel 100 is 40 inches by 40 inches by 1.5 inches, the connector 200 can be 1.5 inches by 1.5 inches by 1.5 inches. In some embodiments, the connector 200 can be the same size as the teeth 108.

As shown, the opening 212 extends through the connector 200 from the upper surface 202 to the lower surface 204. The opening 212 can be configured to receive a fastener, such as the bolt 300 of FIG. 6, therethrough. In use, the bolt 300 is inserted through the opening 212 of the connector 200. The bolt 300 is selected such that a portion of the bolt 300 extends proud from the lower surface 204 of the of the connector 200. The proud portion of the bolt 300 can be engaged with the opening 140 of the post 110. In some embodiments, the opening 212 through the connector 200 is not threaded. As shown in FIG. 4, in some embodiments, the upper surface 202 of the connector 200 includes a recessed portion 214 such that the head of the bolt 300 can be countersunk below the upper surface 202. As further illustrated in FIG. 5, the lower surface 204 of the connector 200 can include a counterbore 216 that is configured to receive the post 110 therein, such that when the connector 200 is secured to the panel 100, the lower surface 204 of the connector can be flush with the side surface of the tooth 108 from which the post 110 extends.

Each of the side surfaces 206 of the connector 200 can include a similar slot 208. The slot can extend from the lower surface 204 and up through the side surface 206 towards the upper surface 202. That is, the lower portion of the slot 208 is open on the lower surface 204 and the upper portion of the slot 208 is closed on the upper surface 202. In the illustrated embodiment, the slot comprises a T-slot. The T-slot is configured to receive and retain the circular flange 138 within the slot 208. In the illustrated embodiment, an upper portion of the slot 208 is rounded. Other shapes and configurations for the slot 208 are possible that correspond and engage with the post 110.

Figure 6:
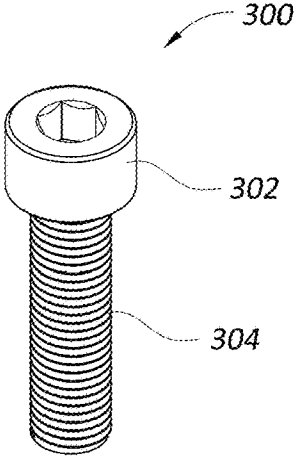
FIG. 6 is a perspective view of a fastener for use with a modular crate system.

FIG. 6 is a perspective view of a fastener or bolt 300 for use with a modular crate system. As shown, the bolt 300 can include a head 302 and threaded shaft 304. In some embodiments, the bolt 300 comprises an M8 bolt, although other sizes and types of bolts and fasteners can be used.

Figure 10:
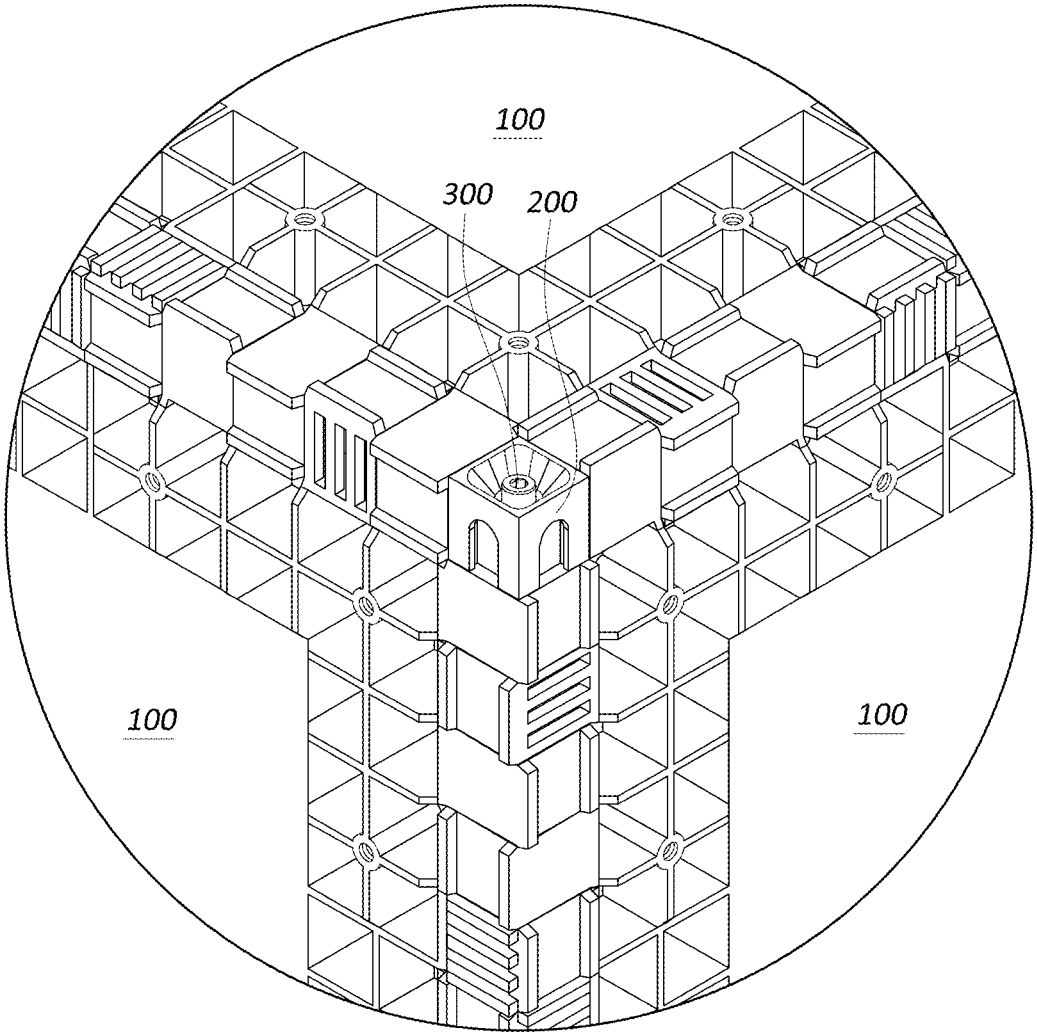
FIG. 10 is a detail view showing an enlarged portion of a corner of a modular crate, such as the modular crate of FIGS. 7-9.
Figure 11:
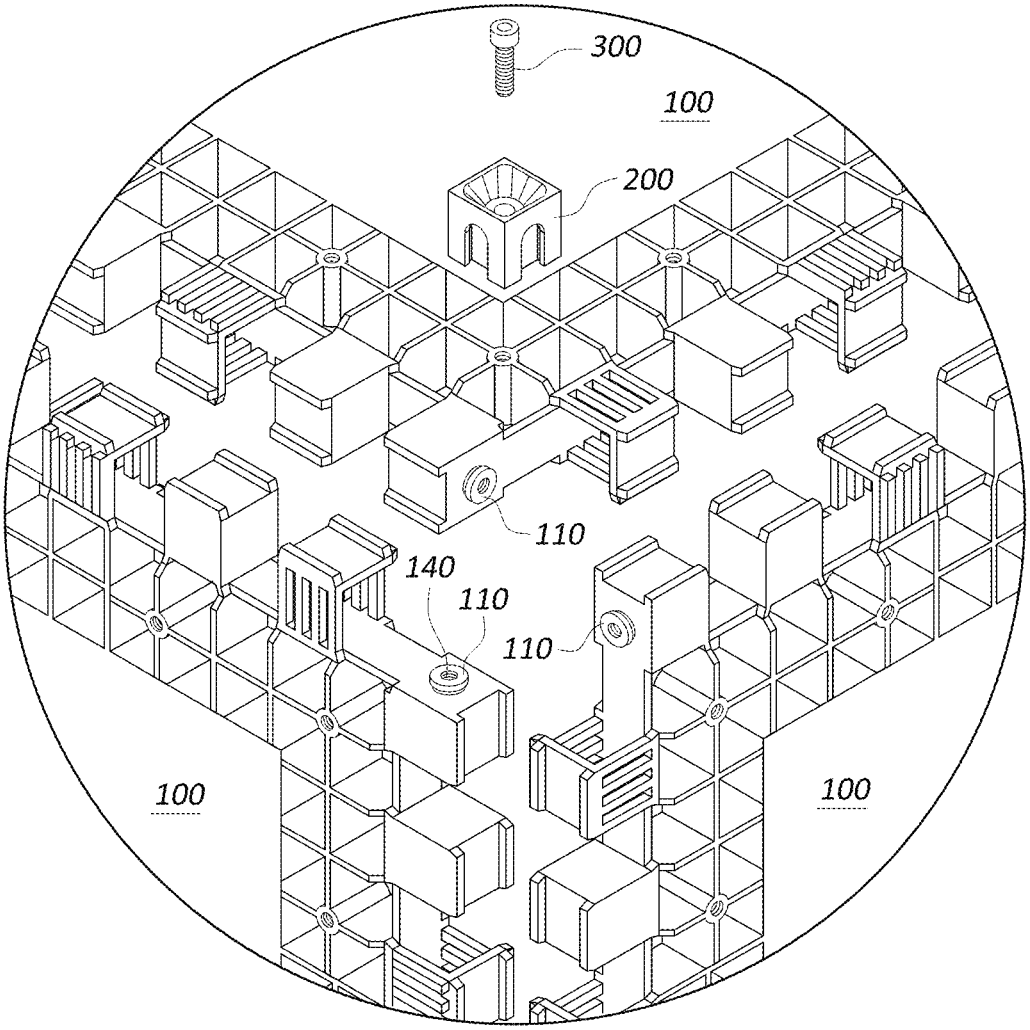
FIG. 11 is an exploded detail view of the corner of FIG. 10.

FIG. 7 is a perspective view showing a first example of a modular crate assembled using a plurality of the panels 100 of FIG. 1, a plurality of connectors 200 of FIG. 4, and a plurality of fasteners 300 of FIG. 6. In this example, six panels 100 are assembled into a cube. Each panel is joined with its adjacent panels 100 at 90-degree angles. A connector 200 and fastener 300 are included each corner of the crate such that six connectors 200 and six fasteners 300 are used. Each connector 200 is engaged with three panels 100 to form a corner as shown in FIGS. 10 and 11, which are described below. Here, if the panels are 40 inches by 40 inches by 1.5 inches, the resulting crate is 40 inches by 40 inches by 40 inches. Of course, these dimensions are provided only by way of example.

Figure 12:
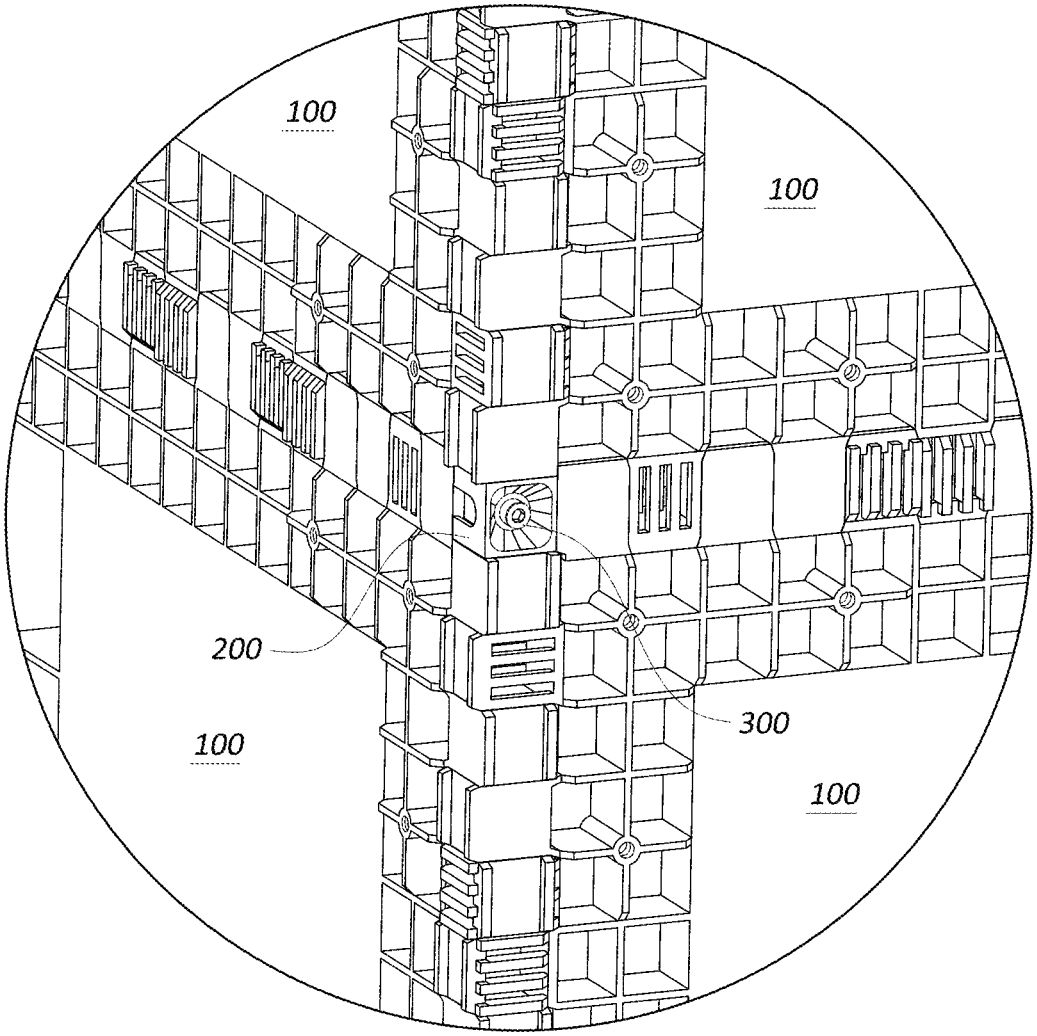
FIG. 12 is a detail view showing an enlarged portion of an edge of a modular crate, such as the modular crate of FIGS. 8-9.
Figure 13:
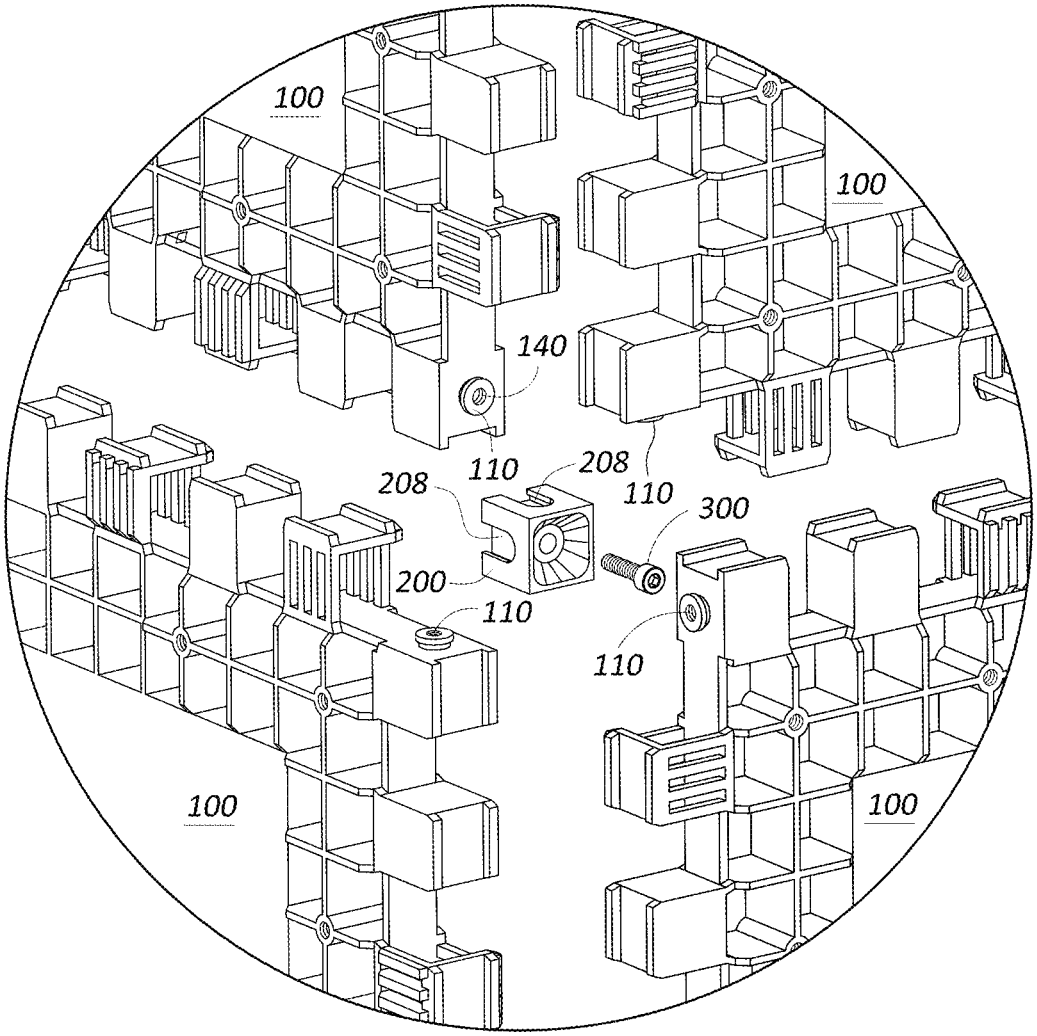
FIG. 13 is an exploded detail view of the edge of FIG. 12.

FIG. 8 is a perspective view showing a second example of a modular crate assembled using a plurality of the panels 100 of FIG. 1, a plurality of connectors 200 of FIG. 4, and a plurality of fasteners 300 of FIG. 6. In this example, ten panels 100 are coupled by twelve connectors 200 and fasteners 300. At each corner of the crate, three panels 100 are joined at 90-degrees to form a corner, for example, as shown in FIGS. 10 and 11. At the midline of each long edge of the crate, four panels are joined with a joint as shown in FIGS. 12 and 13. Here, if the panels are 40 inches by 40 inches by 1.5 inches, the resulting crate is 80 inches by 40 inches by 40 inches. Of course, these dimensions are provided only by way of example.

Figure 14:
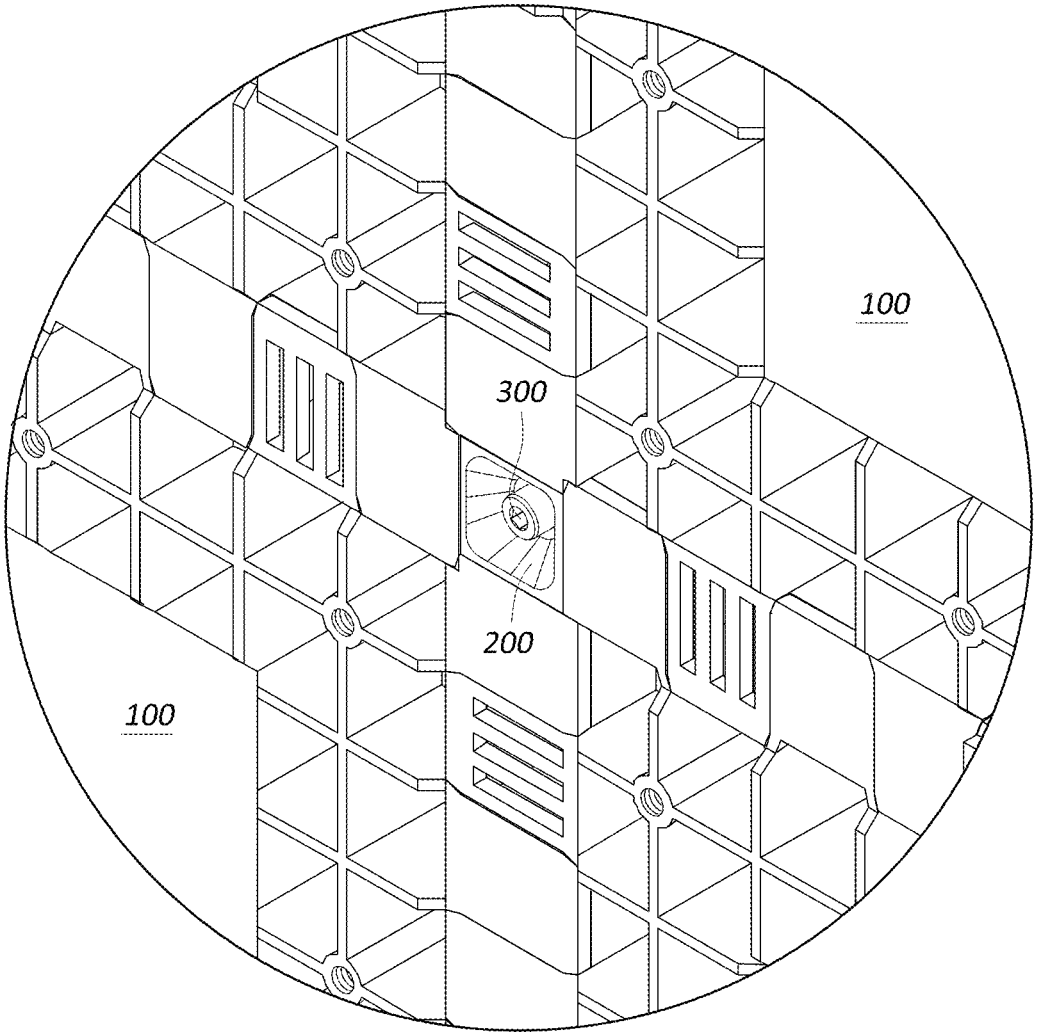
FIG. 14 is a detail view showing an enlarged portion of an outer side of a flat joint between four adjacent panels of a modular crate, such as the modular crate of FIG. 9.
Figure 15:
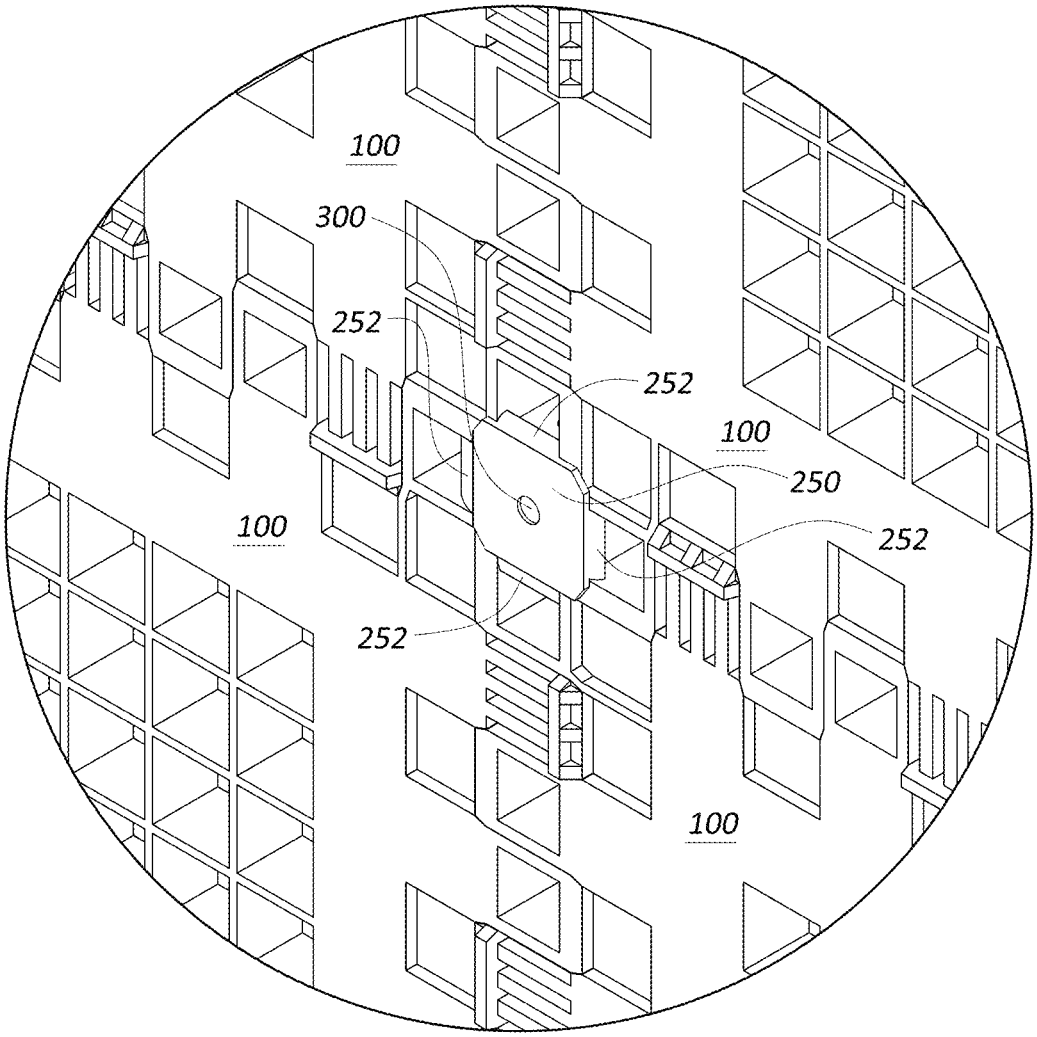
FIG. 15 is a detail view showing an enlarged portion of an inner side of the flat joint of FIG. 14.

FIG. 9 is a perspective view showing a third example of a modular crate assembled using a plurality of the panels 100 of FIG. 1, a plurality of connectors 200 of FIG. 4, and a plurality of fasteners 300 of FIG. 6. In this example, sixteen panels 100 are joined by eighteen connectors 200 and fasteners 300. At each corner of the crate, three panels 100 are joined at 90-degrees to form a corner, for example, as shown in FIGS. 10 and 11. At the midline of each long edge of the crate, four panels 100 are joined with a joint as shown in FIGS. 12 and 13. At the center of each large side of the crate, four panels 100 are joined with a joint as shown in FIGS. 14 and 15. Here, if the panels are 40 inches by 40 inches by 1.5 inches, the resulting crate is 80 inches by 80 inches by 40 inches. Of course, these dimensions are provided only by way of example.

The examples of crates provided in FIGS. 7-9 illustrate only some of the types and sizes of crates that can be assembled using the modular components as described herein. The modular components can be assembled in various configurations as desired to create custom sized creates as needed.

FIG. 10 is a detail view showing an enlarged portion of a corner of a modular crate, such as the modular crate of FIGS. 7-9. FIG. 11 is an exploded detail view of the corner of FIG. 10. In this example, to form a corner, three panels 100 are arranged, each at 90-degrees with respect to the other two. A connector 200 is used at the intersection of the three panels 100 and is secured by a single fastener 300. With reference to the exploded view of FIG. 11 and the orientation shown in the figure, the connector 200 is engaged with the upper panel 100 and the right panel 100 via engagement of the slots 208 (on the rear of the connector 200 relative to the orientation shown) with the posts 110 of the panels 100. The post 110 of the left panel 100 is received within the counterbore 216 on the bottom surface 204 of the connector 200 and the fastener 300 is inserted through the opening 212 of the connector and engaged with the opening 140 of the post 110 of the left panel 100. As shown, advantageously the connector 200 retains all three panels 100 while only requiring one fastener 300.

FIG. 12 is a detail view showing an enlarged portion of an edge of a modular crate, such as the modular crate of FIGS. 8-9. FIG. 13 is an exploded detail view of the edge of FIG. 12. In this example, to form an edge, four panels 100 are arranged as shown in FIG. 12. That is, each panel is arranged at 180-degrees relative to one adjacent panel and 90-degrees relative to the other adjacent panel. A connector 200 is used at the intersection of the four panels 100 and is secured by a single fastener 300. With reference to the exploded view of FIG. 13 and the orientation shown in the figure, the connector 200 is engaged with the upper right panel 100 and the lower right and left panels 100 via engagement of the slots 208 the posts 110 of these panels 100. The post 110 of the upper left panel 100 is received within the counterbore 216 on the bottom surface 204 of the connector 200 and the fastener 300 is inserted through the opening 212 of the connector and engaged with the opening 140 of the post 110 of the upper left panel 100. As shown, advantageously the connector 200 retains all four panels 100 while only requiring one fastener 300.

FIG. 14 is a detail view showing an enlarged portion of a flat joint between four adjacent panels of a modular crate, such as the modular crate of FIG. 9. FIG. 15 is a detail view showing an enlarged portion of an inner side of the flat joint of FIG. 14 . . . . In this example, four panels are arranged at 180-degrees relative to each other. A connector 200 is used at the intersection of the four panels 100. The connector 200 is engaged with the posts 110 of each panel 100 via the slots 208. A fastener 300 is inserted through the opening 212 of the connector and engaged with a plate 250 on the opposite side of the panels 100. The plate 250 includes arms 252 that insert into the openings 124 of the teeth 108 to secure the panels 100 together.

FIG. 16 shows an example modular crate with example handles 402 and wheels 404 attached to outer surfaces thereof. The handles 402 and/or wheels 404 can be selectively attachable to the outer surfaces 104 of the crate via the attachment locations 120 described above with reference to FIG. 2. For example, the handles 402 and/or wheels 404 can include threaded bolts that are configured to be received in the attachment locations 120. The handles 402 and wheels 404 shown in FIG. 16 are provided by way of example and may take other forms than those illustrated. FIG. 17 shows another example modular crate with example handles 402 and legs 406 attached to outer surfaces thereof. Again, the handles 402 and/or legs 406 can be configured to attach to the attachment locations 120. The handles 402 and legs 406 can take other forms than those illustrated. For example, the legs 406 can be longer or shorter or wider or narrower than illustrated. Further, the legs 406 can be hard or soft legs. FIG. 18 shows another example modular crate with example handles 402 and a pallet base 408 attached to outer surfaces thereof. The handles 402 and/or the pallet base 408 can be configured to attach to the attachment locations 120. The pallet base 408 can be configured for use with a forklift or pallet jack to further facilitate handling of the crate. FIGS. 16-18 illustrate various external devices that can be attached to the exterior of a modular crate, other devices are also possible. Further, the external devices can quickly and easily be installed, swapped, and/or removed to further allow customization of the crates.

FIG. 19 illustrates an example joint between two modular panels 100 that includes a rod 502 to strengthen the joint. FIG. 20 is an exploded view of the joint of FIG. 19. As shown in FIGS. 19 and 20, a rod 502 can be inserted through intermeshed teeth 108 of two adjacent panels 100. The rod 502 can comprise, for example, a metal rod, such as a steel rod, although other materials can also be used. Because the rod extends through the intermeshed teeth 108, for example, through openings in each tooth 108, the rod 502 secures the two panels 100 together. The rod 502 can be inserted through the opening in the post 110. The rod 502 can be retained in place by a connector 200 (not shown in FIGS. 19 and 20) when the connector 200 is installed on the post 110.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the figures may be combined, interchanged or excluded from other embodiments.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims. Applicant reserves the right to submit claims directed to combinations and sub-combinations of the disclosed inventions that are believed to be novel and non-obvious. Inventions embodied in other combinations and sub-combinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

What is claimed is:

1. A panel for a modular crate system, the panel comprising:

a rectangular body comprising:

an inner surface and an outer surface, wherein the outer surface is opposite the inner surface, and a first edge, a second edge, a third edge, and a fourth edge, wherein the first edge is opposite the third edge, and wherein the second edge is opposite the fourth edge; and each edge of the first edge, the second edge, the third edge, and the fourth edge, comprises a plurality of teeth extending outwardly from the edge, wherein:

each of the plurality of teeth are spaced apart such that the plurality of teeth is configured to intermesh with a plurality of teeth of an adjacent panel of the modular crate system to form at least a portion of a modular crate, each of the plurality of teeth includes a first tooth positioned at one end of the edge, the first tooth comprising a post configured to engage with a slot of a connector to couple the panel to the adjacent panel, and each of the plurality of teeth further comprises at least two different types of teeth, the two different types of teeth comprising:

a first tooth type; and a second tooth type.

2. The panel of claim 1, wherein the first tooth type and the second tooth type are alternatively positioned along each of the plurality of teeth for at least a portion of a length of a corresponding edge.

3. The panel of claim 1, wherein each tooth of the first tooth type comprises an opening extending through the tooth from a first side face of the tooth to a second side face of the tooth.

4. The panel of claim 3, wherein each tooth of the second tooth type comprises an opening extending through the tooth from a third side face of the tooth to a fourth side face of the tooth.

5. The panel of claim 1, wherein between each tooth of the plurality of teeth:

the inner surface of the rectangular body comprises a recess formed into the inner surface; and the outer surface of the rectangular body comprises a recess formed into the outer surface.

6. The panel of claim 5, wherein each recess of the inner surface and the outer surface is configured to receive a flange of a tooth of the plurality of teeth of the adjacent panel of the modular crate system.

7. The panel of claim 1, wherein the post comprises a cylindrical projection terminating in a circular flange.

8. The panel of claim 7, wherein the post comprises an opening extending along a longitudinal axis of the post.

9. The panel of claim 8, wherein the opening is threaded and configured to receive a bolt.

10. The panel of claim 9, wherein the bolt comprises an M8 bolt.

11. The panel of claim 1, wherein the rectangular body is square.

12. The panel of claim 11, wherein the panel is 40 inches by 40 inches by 1.5 inches.

13. A modular crate system, comprising:

the panel of claim 1; and a connector for coupling the panel to another panel, the connector comprising:

a cubic body comprising an upper surface and an opposed lower surface, and four side surfaces extending between the upper surface and the lower surface;

an opening extending through the cubic body from the upper surface to the lower surface; and for each of the side surfaces, a T-shaped slot formed into the side surface and extending from the lower surface towards the upper surface.

14. The system of claim 13, wherein the opening of the connector is configured to receive a shaft of a bolt therethrough.

15. The system of claim 14, wherein the opening of the connector is not threaded.

16. The system of claim 14, wherein the bolt comprises an M8 bolt.

17. The system of claim 13, wherein the upper surface of the connector comprises a recess configured to receive a head of a bolt inserted through the opening.

18. The system of claim 13, wherein a closed end of each of the T-shaped slots is rounded.

19. The system of claim 13, wherein the cubic body of the connector is 1.5 inches by 1.5 inches by 1.5 inches.

* * * * *